US005366395A

United States Patent [19]

Mostaghel et al.

[11] Patent Number: 5,366,395

[45] Date of Patent: Nov. 22, 1994

[54] PULSATING IMPELLER

[75] Inventors: Naser Mostaghel; Edward Lumsdaine, both of Toledo, Ohio

[73] Assignee: The University of Toledo, Toledo, Ohio

[21] Appl. No.: 985,170

[22] Filed: Dec. 2, 1992

[51] Int. Cl.[5] ..... B63H 1/30

[52] U.S. Cl. ..... 440/17; 440/13; 417/77

[58] Field of Search ..... 440/5, 13, 17–19, 440/38, 23, 98, 113, 75, 85, 86; 244/73 R, 74; 417/77, 118, 137; 180/7.3; 60/200.1, 221; 114/337

[56] References Cited

U.S. PATENT DOCUMENTS

| | | | |
|---|---|---|---|
| 2,983,244 | 5/1961 | Young | 440/23 |
| 3,048,140 | 8/1962 | Davis, Sr. | 440/38 |
| 3,307,358 | 3/1967 | De La Roche Kerandraon | 440/18 |
| 3,479,674 | 11/1969 | Beymer | 440/18 |
| 3,556,039 | 1/1971 | Sfredda | 440/17 |
| 4,246,861 | 1/1981 | Mikina et al. | 440/17 |

FOREIGN PATENT DOCUMENTS

| | | | |
|---|---|---|---|
| 913868 | 6/1954 | Germany | 440/23 |

*Primary Examiner*—Robert J. Oberleitner
*Assistant Examiner*—Clifford T. Bartz
*Attorney, Agent, or Firm*—Marshall & Melhorn

[57] ABSTRACT

A pulsating impeller system is provided for moving a body through a fluid medium. The pulsating impeller includes an enclosure mounted on a vessel or other body. The enclosure is provided with an inlet-outlet aperture to facilitate the flow of the fluid medium into and out of the enclosure. An expansible membrane is positioned in the enclosure. The volume of the expansible membrane is inflated and deflated on a regular cycle by a compressed air or other similar system in the vessel. When the enclosure is placed in a fluid, such as water, and the expansible membrane inside the enclosure is inflated, the volume of the membrane is increased, which results in the water being forced through the outlet hole in the enclosure to propel the vessel. This force will generate a reactive force which will thrust the enclosure and vessel in the opposite direction. The vessel may be provided with a plurality of enclosures, and each enclosure may have one or more expansible membranes. The force provided to drive the vessel depends on the number and positioning of the enclosures and the operating cycles for the expansible membranes.

13 Claims, 2 Drawing Sheets

PULSATING IMPELLER

BACKGROUND OF THE INVENTION

The current technique for impelling a body through a fluid medium generally involves the action of a propeller to generate the thrust needed to push the body forward. The rotation and the vibration of the propeller and associate shaft, mountings, drive means, etc. generate noise, and an elaborate structural system is needed to mount and hold the propeller assembly in place.

In the known systems employing propellers, it is necessary to provide fluid resistant bearing means in the areas of the hull through which the propeller shafts extend. As wear occurs between the relatively moving bearing means, fluid such as sea water may be able to enter the bilge and if not replaced or repaired will eventually overtax the bilge pumping system resulting in rather serious consequences.

SUMMARY OF THE INVENTION

The present invention is directed to an alternate technology having many attendant advantages. Among the advantages is that the pulsating impeller system is relatively easily mounted to the hull of a water craft, for example. The resultant system is considerably free from vibration during operation and relatively quiet.

Due to the simple structural aspects of the invention, the pulsating impeller system can be distributed or clustered on a craft being propelled. Each pulsating impeller unit is composed of an enclosure with an inlet-outlet hole. Inside the enclosure is placed a throbbing body whose volume can be changed by doing work on it. An example of a throbbing body embodying such characteristic is a simple balloon; the throbbing and volume change can be induced by periodic inflation and deflation of the balloon. Other examples include a material which changes its volume when subjected to an electric charge, any mechanism pushing a fluid out of the enclosure intermittently, or simply a pulsating membrane covering the hole of the enclosure. The throbbing body is connected to an energizer line through the boundary of the enclosure. When the enclosure is placed in a fluid, such as water, and the throbbing body inside the enclosure is energized, the throbbing body's volume is increased. To accommodate the increase in the throbbing body's volume, water will be pushed out through the outlet hole in the enclosure. This push will generate a reactive force which will thrust the enclosure in the opposite direction. When the enclosure is attached to another system, for example a craft, the attached system will also move with the enclosure. The speed with which a given system equipped with a pulsating impeller can move depends on how fast and how often the fluid is pushed out of the enclosure of the impeller unit. The speed in turn depends on the pulse frequency and on the amount of volume change associated with each pulse of the throbbing body inside the impeller unit.

Since many impeller units can be used to provide the needed thrust to move a given craft, and since the impeller unit can be distributedly attached to the craft, even if a number of them fail or are damaged, the craft will still be able to move on the power of the remaining impellers. In practice, impellets with different capacities can be attached to a given craft to provide the required cruising speed. The impeller units may also be attached in various directions to provide for easier and quicker maneuverability. Besides boat and barges, the proposed impeller system can be used for large hulls carrying petroleum or other environmentally hazardous materials. The shells enclosing the throbbing bodies act as a second layer of skin over the body of the hull, providing a higher degree of protection against spillage due to any cause. Also, due to the relatively quiet operation, the pulsating impeller system may be quite suitable for use in "silent" submarines.

The above advantages of the invention may typically be achieved by an impeller, for imparting movement to a body through a fluid medium, which is comprised of means attached to the body for impelling the body through the fluid medium and including an enclosure having a fluid inlet-outlet hole, an expansible member disposed within the enclosure, and means for varying the volume of the expansible member to cause fluid within the enclosure to be expelled through the enclosure's inlet-outlet hole.

BRIEF DESCRIPTION OF THE DRAWINGS

Other objects and advantages of the invention will become readily apparent to those skilled in the art from reading the following detailed description of a preferred embodiment of the invention when considered in the light of the attached drawings, in which:

FIG. 4 is a first graph showing a plot of the non-dimensionalized velocity for various values of drag coefficient parameter a.

DETAILED DESCRIPTION OF PREFERRED EMBODIMENTS OF THE INVENTION

Figure 1:
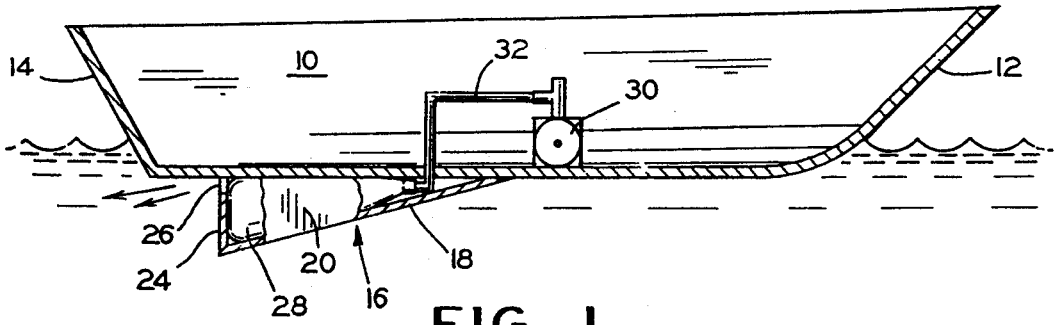
FIG. 1 is a schematic illustration of a water craft incorporating an impeller unit employing the feature of the invention.

Referring to the drawing, there is shown in FIG. 1 in schematic form a pulsating impeller according to the invention. A hull of a watercraft is generally designated by reference number 10. The hull 10 is provided with a bow 12 and a stern 14. An enclosure 16 is attached to the outside surface of the hull 10. The enclosure 16 is formed by an inclined bottom wall 18, a pair of spaced apart side walls 20, 22, and a rear wall 24. The rear wall 24 is provided with an aperture 26.

The enclosure 16 defines an interior space employed to contain a balloon 28 formed of a flexible, fluid impervious material such as rubber, for example. The interior of the balloon or a balloon-like object 28 communicates with a source of pressure fluid, such as a pump 30, for example, through a line 32.

In operation, it will be assumed that the balloon 28 is collapsed and the remaining interior volume of the enclosure 16 surrounding the exterior of the balloon 28 is filled with water or another fluid. Pressure fluid is then introduced into the interior of the balloon 28 through the line 32. As the balloon 28 is inflated, the water in the interior of the enclosure 16 is caused to be forced outward through the aperture 26.

The rearwardly directed jet of water being forced out of the enclosure 16 generates a thrust tending to push hull 10 forward in an opposite direction. When the balloon 28 is fully inflated, the jet of water flowing outwardly of the enclosure 16 will stop. The balloon 28 is then caused to become deflated, allowing water to re-enter the enclosure 16 through the aperture 26. Once the deflation of the balloon 28 ceases, and the water has filled the interior space of the enclosure 16, another thrust cycle may typically commence to propel the hull 10 forwardly.

Figure 2:
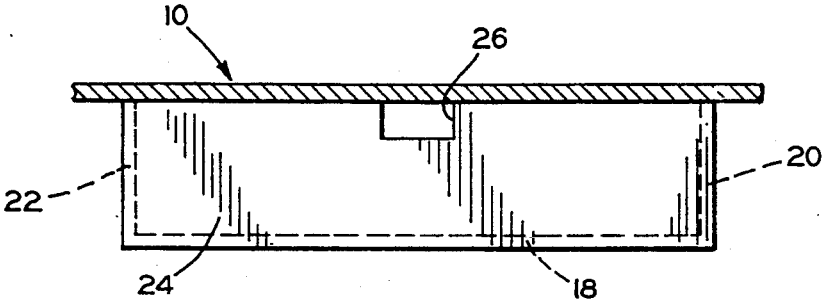
FIG. 2 is a fragmenting rear view of the unit illustrating the inlet-outlet aperture in the rear wall of the enclosure.
Figure 3:
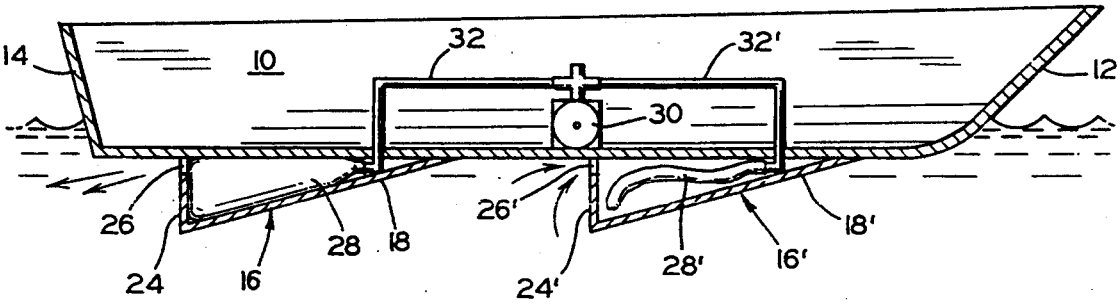
FIG. 3 is similar to FIGS. 1 and 2 and more specifically schematically illustrates a water craft incorporating an impeller system employing several of the impeller units illustrated in FIGS. 1 and 2.

In order to minimize the intermittent pulsing of the single impeller unit shown in FIG. 1, FIG. 3 illustrates a system comprised of two separate units. The impeller units are substantially identical to each other and to the unit illustrated in FIGS. 1 and 2. Accordingly, primed reference numerals will be used to designate similar structural elements.

If a steady stream of water flows out of the impeller system at a flow rate q, and if the cross-sectional area through which this stream flows (in this case the area of the inlet-outlet hole in one of the enclosures) is A, and if the mass of the water per unit volume is r, then based on Newton's second law, it can be shown that $$Mu''+F_d=rq^2/A \tag{1}$$

Here, M is the total mass of the craft and the impeller system, $F_d$ is the drag force and u'' is the resulting system acceleration. If one assumes the drag force to be linearly proportional to the system velocity, u', then equation (1) can be rewritten as $$Mu''+c\,u'=rq^2/A \tag{2}$$

where c is a drag coefficient. If the system is to be cruising at a constant velocity, v, then the acceleration term u'', in the above equation would be zero, and equation (2) would yield $$cv=rq^2/A \tag{3}$$

Hence, the cruising velocity is given by $$v=rq^2/Ac \tag{4}$$

and equation (2) can be rewritten as $$u''+(c/M)u'=(c/M)v \tag{5}$$

Assuming at rest initial conditions, i.e. u(O)=0, u'(O)=0, the solution of equation (5) for the non-dimensionalized velocity can be represented by $$(u'/v)=1-e^{-at} \tag{6}$$

where $$a=c/M \tag{7}$$

Alternatively, for the cruising velocity, v, a can be represented by $$a=(g/v)(F_d/W) \tag{8}$$

Here, g represents the gravitational acceleration and W is the total weight of the superstructure impeller system. A plot of the non-dimensionalized velocity, (u'/v), for various values of a is given in shown in FIG. 1.

The flow rate, q, necessary to generate a given cruising velocity, v, can be estimated from equation (4) to be $$q=b\,v^{\frac{1}{2}},$$

where b is defined by $$b=(Ac/r)^{\frac{1}{2}} \tag{10}$$

Figure 5:
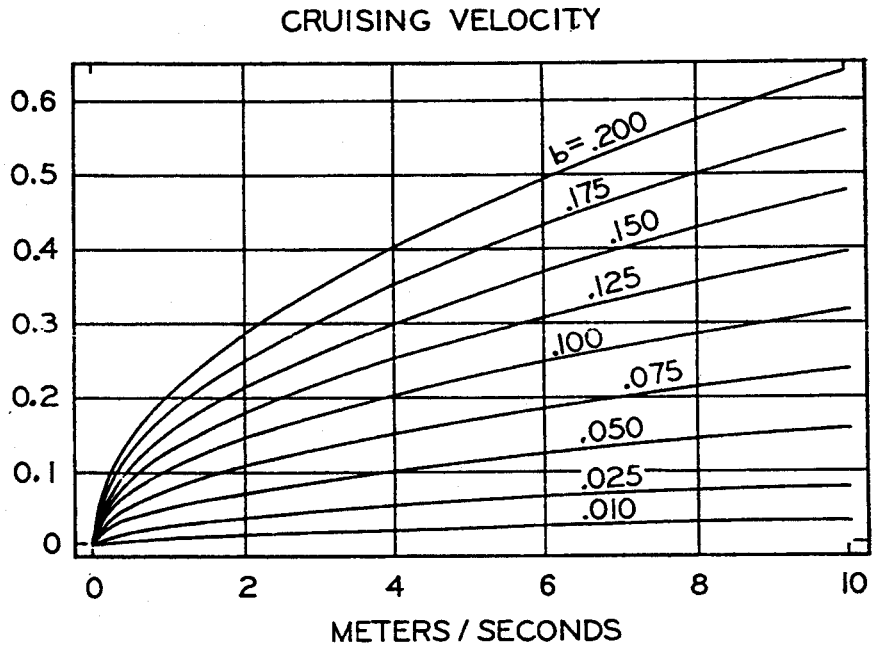
FIG. 5 is a second graph showing variations of the flow rate with a specified cruising velocity of various values of the parameter b.

A plot of variations of the flow rate, q, with the cruising velocity, v, for various values of the parameter b is given in shown in FIG. 5.

Figure 4:
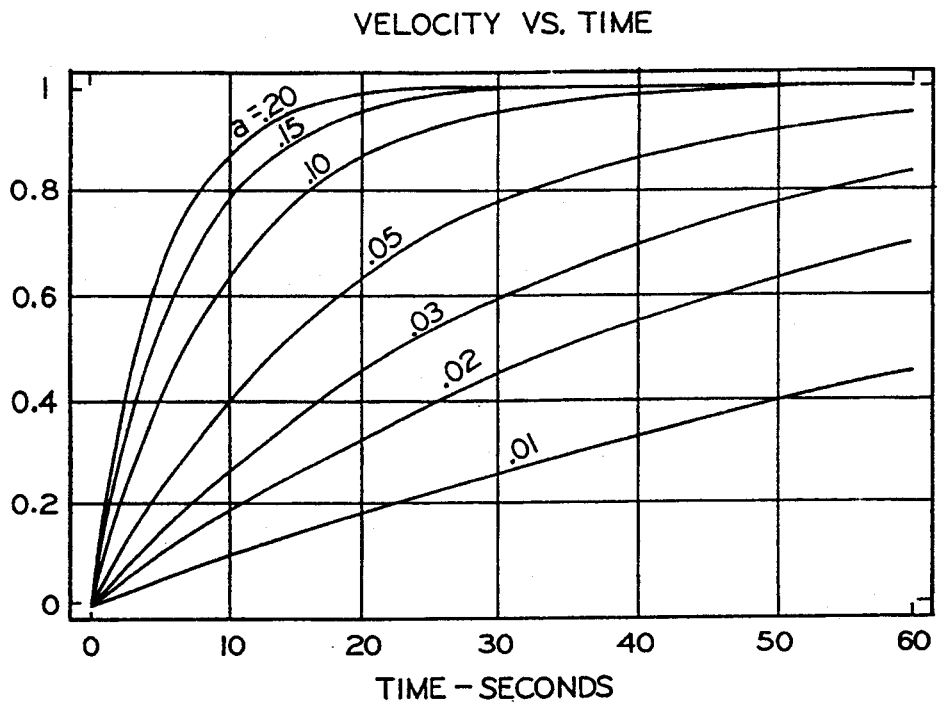

It is interesting to note that according to FIG. 4, the higher the value of the parameter a, that is, the larger the value of the drag coefficient c, the higher is the rate of buildup of the velocity. This may appear to be paradoxical. However, FIG. 5 shows that the larger the value of the drag coefficient, the larger is the required flow rate. The larger flow rate yields a higher amount of thrust, which propels the system to approach the cruising velocity at a higher rate.

An alternative configuration for the pulsating impeller would be to eliminate the throbbing body from the enclosure and cover the outlet hole of the enclosure with an elastic membrane. The periodic pressurization and depressurization of the enclosure will push the membrane in and out and generate a thrust.

While the drawings illustrated only a single balloon 28 in the interior of the enclosure 16, satisfactory results could be achieved by the employment of a plurality of balloons or balloon-like objects. Also, the balloon structure can be substituted for a porous medium such as a sponge structure, for example, which would expand and contract to expel the fluid in the enclosure to effect propulsion of the associated craft.

Figure 2A:
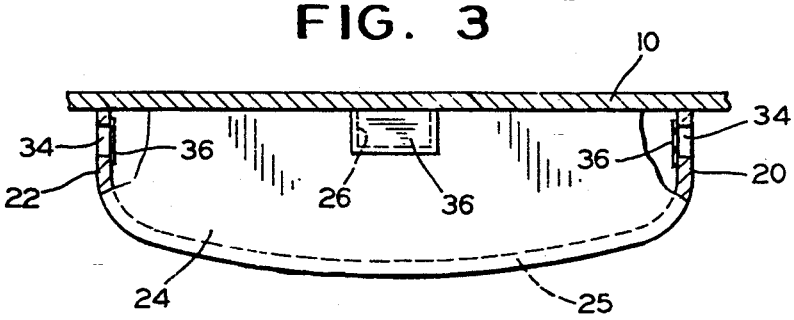
FIG. 2A shows an alternative embodiment of the enclosure provided with a curved bottom wall and separate inlet and outlet apertures.

Obvious other modifications could be made including forming the enclosure 16 to have a curved outer wall 35 configuration shown in FIG. 2A. To assist in increasing the overall efficiency, the outer wall could, in addition to being curved, taper forwardly.

While the preferred embodiment of the invention discloses an inlet-outlet having a predetermined area, it must be understood that certain advantages may be achieved by providing means for selectively varying the area or size of the inlet-outlet aperture.

Also, the invention contemplates an embodiment wherein the single inlet-outlet aperture can be comprised of an outlet aperture 26 in the rear wall 24 of the FIG. 2A embodiment, and inlet apertures 34 in the side walls 20 and 22. In such an embodiment, the outlet and inlet apertures are provided with suitable valve means 36, such as flap-type valves, for example. The valve means are designed such that during the time fluid is being expelled through the outlet aperture, fluid transmission through the inlet apertures is blocked. Upon a decrease in volume of the expansible member, fluid flow through the outlet aperture is blocked and fluid is permitted to flow through the inlet apertures.

In accordance with the provisions of the patent statutes, a preferred embodiment of the invention has been illustrated and described. It must, however, be kept in mind that the spirit of the invention may be embodied in other structural configurations as defined in the appended claims.

What is claimed is:

1. An impeller for moving a body through a fluid medium comprising:

an enclosure having a fixed volume and an aperture to facilitate the movement of a fluid medium into and of said enclosure;

means for attaching said enclosure to an associate body such that the aperture is positioned in the fluid medium;

expansible member permanently disposed within said enclosure; and pumping means for varying the volume of the expansible member; said pumping means mounted in the associated body and connected to said expansible member in said enclosure, the deflation of said expansible member permits fluid medium to enter said enclosure and the inflation of said expansible member causes fluid medium within said enclosure to be expelled through the aperture to move the body.

2. The invention defined in claim 1 wherein said expansible member includes a flexible membrane.

3. The invention defined in claim 2 wherein said flexible men, fane is formed of rubber.

4. The invention defined in claim 2 wherein said flexible membrane is fluid impervious.

5. The invention defined in claim 1 wherein said expansible member includes a plurality of flexible membranes.

6. The invention defined in claim 1 wherein said pumping means for varying the volume of the expansible member includes a pump.

7. The invention defined in claim 1 wherein said enclosure includes a rear wall having aperture formed therein, a pair of tapered side walls, and a planar bottom wall extending between the tapered side walls from the rear wall to the associate body.

8. The invention defined in claim 7 wherein the bottom wall of said enclosure is curved.

9. The invention defined in claim 1 wherein said enclosure includes separate inlet and outlet apertures.

10. The invention defined in claim 9 including means for selectively varying the size of the apertures in said enclosure.

11. The invention defined in claim 9 wherein the apertures in said enclosure are connected to valves for controlling the flow of fluid medium through the apertures.

12. An impeller for moving a vessel through a body of water comprising:

a fixed enclosure having a plurality of apertures to facilitate the movement of water into and out of said enclosure;

control valves connected to the apertures in said enclosure to selectively control the flow of water through the apertures;

means for attaching said enclosure to a vessel such that the apertures are positioned in water when the vessel is in a body of water;

at least one expansible membrane disposed within said enclosure; and pumping means for varying the volume of said expansible membranes, said pumping means mounted in the vessel and connected to said expansible membranes in said enclosure, the selective deflation of said expansible membranes permits fluid medium to enter said enclosure and the selective inflation of said expansible membranes causes water within said enclosure to be expelled through selected apertures to move the vessel in the body of water.

13. An impeller system for moving a vessel through a body of water comprising:

a plurality of fixed enclosures, each enclosure having a plurality of apertures to facilitate the movement of water into and out of said enclosure;

control valves connected to the apertures in said enclosures to selectively control the opening and closing of the apertures;

means for attaching said plurality of enclosures to a vessel such that the apertures of said enclosures are positioned in water when the vessel is in a body of water;

at least one expansible membrane disposed within each of said plurality of enclosures; and pumping means for varying the volume of said expansible membranes, said pumping means mounted in the vessel and connected to said expansible membranes in said plurality of enclosures, the selective deflation of said expansible membranes permits fluid medium to enter said enclosure and the selective inflation of said expansible membranes causes water within said enclosure to be expelled through selected apertures to move the vessel in the body of water.

* * * * *